United States Patent [19]

Borgese et al.

[11] Patent Number: 4,989,266

[45] Date of Patent: Feb. 5, 1991

[54] BODY ARMOR INSERT

[75] Inventors: Anthony J. Borgese, Lynbrook; Gaeton J. Dragone, Croton Falls; David R. Hand, Kings Park, all of N.Y.

[73] Assignee: Point Blank Body Armor, Inc., Amityville, N.Y.

[21] Appl. No.: 421,077

[22] Filed: Oct. 13, 1989

[51] Int. Cl.[5] ..... F41H 1/02

[52] U.S. Cl. ..... 2/2.5; 2/167

[58] Field of Search ..... 2/2.5, 167

[56] References Cited

U.S. PATENT DOCUMENTS

| | | | |
|---|---|---|---|
| 3,891,996 | 7/1975 | Leach et al. | 2/2.5 |
| 4,287,607 | 9/1981 | Leach | 2/2.5 |
| 4,413,357 | 11/1983 | Sacks | 2/2.5 |
| 4,483,020 | 11/1984 | Dunn | 2/2.5 |
| 4,497,069 | 2/1985 | Braunhut | 2/2.5 |
| 4,510,200 | 4/1985 | Samowich | 2/2.5 |
| 4,608,717 | 9/1986 | Dunbavand | 2/2.5 |
| 4,623,574 | 11/1986 | Harpell et al. | 2/2.5 |
| 4,879,165 | 11/1989 | Smith | 2/2.5 |

*Primary Examiner*—Allan N. Shoap
*Assistant Examiner*—Daniel G. DePumpo
*Attorney, Agent, or Firm*—McAulay Fisher Nissen & Goldberg

[57] ABSTRACT

A body armor insert has a set of ballistic cloth plies made from polyethylene fibers sandwiched between first and second sets of ballistic cloth plies made from aramid fiber. The number of plies in each of the three sets of plies is a function of a level of protection to be provided. Each of the two sets of aramid plies are sewn together along a central region of the set of plies. The set of polyethylene fiber plies are not sewn together except that all three sets of plies are sewn together in a shoulder region of the body armor insert.

11 Claims, 2 Drawing Sheets

BODY ARMOR INSERT

BACKGROUND OF THE INVENTION

This invention relates to an improved body armor insert which protects the wearer from bullets.

The use of protective body armor formed of ballistic cloth woven from aramid fibers is known in the art. This cloth protects the wearer from bullets. Commercial cloth is available that is made from an aramid fiber sold by DuPont under the trademark Kevlar.

Protective body armor formed of ballistic cloth made from polyethylene is also known in the art. This cloth also protects the wearer from bullets. Commercial cloth is available that is made from a polyethylene fiber sold by the Allied Fibers division of Allied Signal Technologies under the trademark Spectra.

The protection afforded by both the aramid cloth and the polyethylene cloth depends upon the number of plies of the cloth and thus can be selected to provide the required protection.

In forming a protective body armor insert there are a number of parameters to consider. Of primary importance, the insert must protect the user from the penetration and impact of a bullet.

Different degrees of protection are provided to protect a wearer from different types of weapons and accordingly protective armor is classified into different protection levels. Additionally, since the protective armor is intended for frequent and long periods of use it is important to make it as comfortable to wear as possible. Weight and flexibility, along with material feel are factors that impact on wearer's comfort. Since additional layers of material add both additional weight and protection, in forming a protective insert a trade-off must be made between protection level and comfort. If a protective device is not sufficiently comfortable it will not be used and thus will afford no protection.

Accordingly it is the major purpose of the present invention to provide a body armor insert which meets a predetermined standard of bullet protection and which is light weight and more comfortable than prior inserts meeting the same standard of protection.

A related purpose of this invention is to provide such a body armor insert which is relatively flexible and which has an acceptable wearing feel.

BRIEF DESCRIPTION

In brief, in one embodiment of this invention a protective body armor insert is provided which includes three sets of plies. Two sets of plies are formed of a ballistic cloth woven from aramid fibers. A third set of plies is formed of a ballistic cloth made from polyethylene fibers. The plies of the insert are arranged such that the set of polyethylene plies is sandwiched between first and second sets of aramid plies.

BRIEF DESCRIPTION OF THE FIGURES

FIG. 1 is shown in cut away form in order to illustrate the various layers.

FIG. 2 is on a very much expanded scale compared to FIG. 1 in order to illustrate each ply.

FIG. 3 is on a scale permitting the separate showing of each set of plies as a set but inadequate to show the individual plies within each set. FIG. 2 shows the individual plies within each set.

FIG. 4 shows the stitching 18 through one set of aramid plies.

DESCRIPTION OF THE PREFERRED EMBODIMENTS

Figure 1:
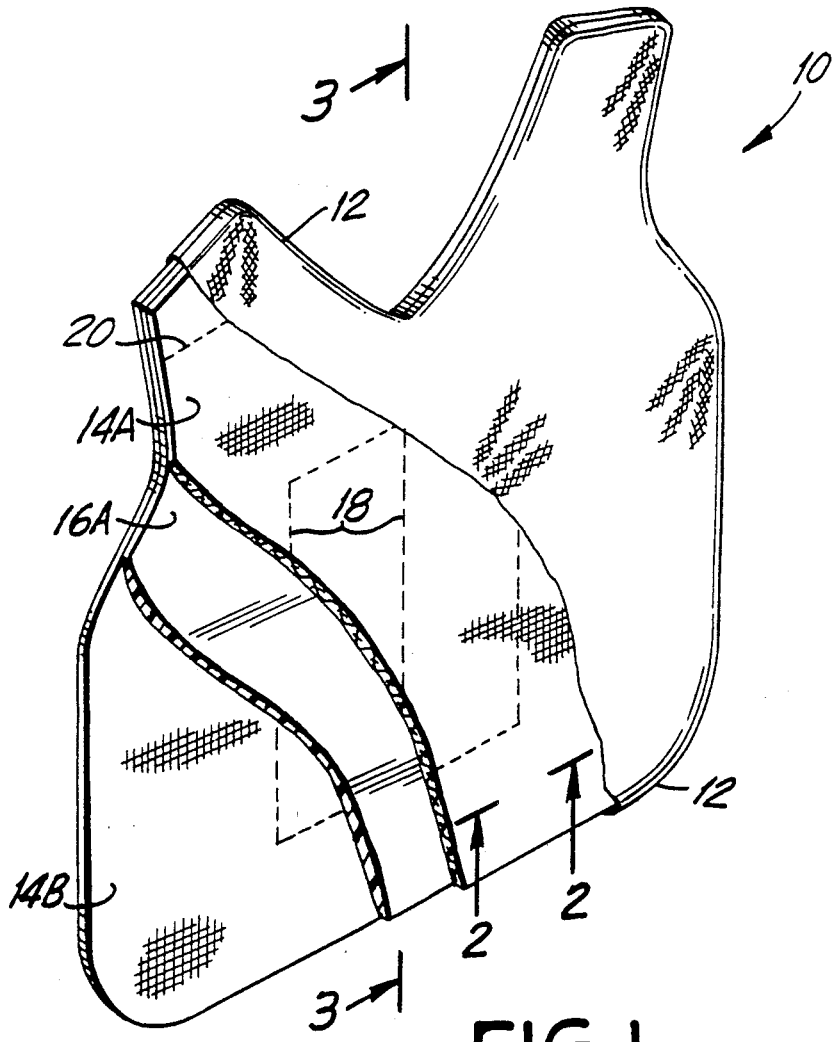
FIG. 1 is a perspective view of the body armor insert of this invention.

Referring now to the drawings, the reference numeral 10 generally denotes the improved body armor insert of the present invention. Body armor insert 10 is shaped and dimensioned to provide protection to a wearer's upper torso. Body armor insert 10 is intended to be inserted into vest-like wearing apparel so that it can be easily and comfortably worn by a police officer or other individual who needs protection from bullets.

Body armor insert 10 is formed of a plurality of discrete fiber plies. The fiber plies are of two types: the first type of plies 14 are formed of woven aramid fibers. The second type of plies 16 are formed polyethylene fibers laid up in orthogonal fashion. These polyethylene fibers which form polyethylene plies 16 are encased in a polyethylene film to hold the laid up fibers in place. Both the aramid plies and the polyethylene plies are known plies in the art. Each aramid ply 14 is about 15 mils thick and each polyethylene ply 16 is about 6.5 mils thick.

The aramid plies 14 are grouped into two sets, a first set 14A and a second set 14B. The polyethylene plies 16 are grouped in a single set 16A. Depending upon the amount of protection required different number of plies 14 and 16 are used to form body armor insert 10. The ply sets are all contained within a fabric insert casing 12.

In a preferred embodiment, insert 10 is intended to protect a wearer from bullets from a hand gun and is classified as a Level 1 protective device. In Level 1 embodiment, the first set 14A of aramid plies is comprised of four plies, the second set 14B of aramid plies is comprised of four plies and set 16A of polyethylene plies is comprised of six plies. In this arrangement, as in other arrangements for the body armor insert 10, set 16A of polyethylene plies 16 is sandwiched between the two aramid ply sets 14A and 14B.

Figure 2:
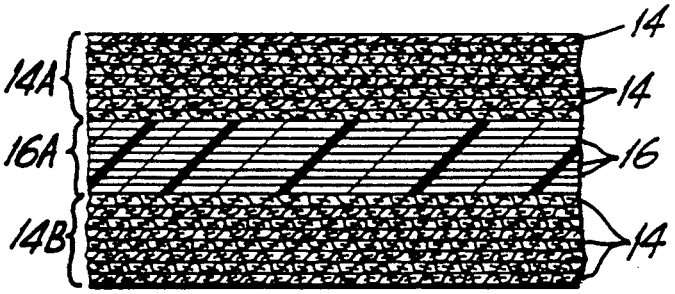
FIG. 2 is a section through the plane 2—2 of FIG. 1 illustrating each of the plies 14, 16 that constitutes the three sets of plies 14A, 14B and 16A of the FIG. 1 device.
Figure 3:
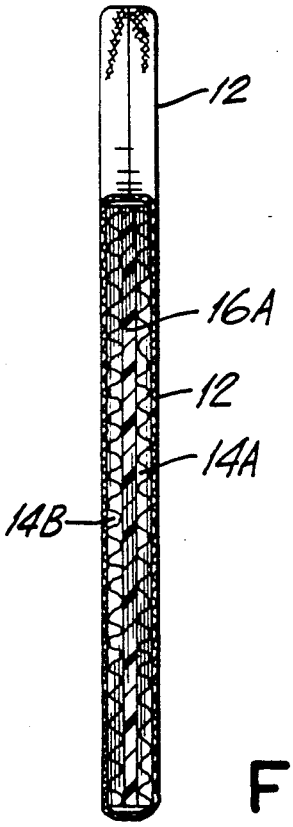
FIG. 3 is a sectional view along the plane 3—3 of FIG. 1.
Figure 4:
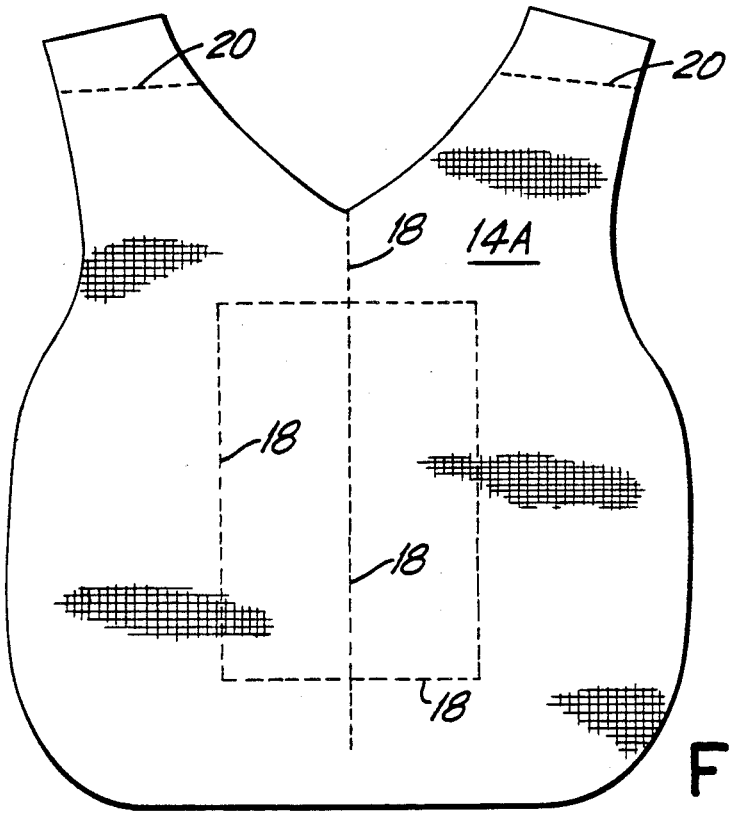
FIG. 4 is a plan view of the insert without the fabric casing 12.

When insert 10 is intended for Level 2A protection the first set 14A of aramid plies contains six plies, the second set 14B of aramid plies contains six plies, and set 16A of polyethylene plies contains ten plies. For Level 2 protection, first set 14A and second 14B of aramid plies each contain eight plies while set 16A of polyethylene plies contain ten plies. When insert 10 is for a Level 3A protection, both first set 14A and second set 14B of aramid plies contain ten plies each while set 16A of polyethylene plies contains fourteen plies. FIG. 2 illustrates a Level 2A design.

Each ply 14, 16 of the body armor insert 10 is in full surface contact with adjacent plies.

The plies in each set of aramid plies 14A, 14B are sewn to one another along central seams 18. All of the plies 14 and 16 are sewn together at seams 20 along the upper shoulder regions of the body armor insert 10. It is preferred to have no other stitching through the polyethylene plies 16 since it has been found that stitching through the polyethylene plies may adversely affect the way those plies protect a wearer from the impact of a bullet. The polyethylene ply set 16A however is sandwiched between the aramid ply sets 14A and 14B which thus holds the polyethylene plies securely in place.

By using both polyethylene plies and aramid plies, insert 10 provides optimal comfort and protection. It has been found that on a comparative weight basis polyethylene fiber plies provide better protection from bullets than do aramid fiber plies. However, the polyethylene fiber plies are stiff and do not have an acceptable feel. Accordingly, by sandwiching the polyethylene plies between the more flexible aramid plies, which have a more acceptable feel, the insert 10 provides good ballistic protection, at light weight with acceptable flexibility and comfort.

In each of the above recited embodiments of this invention, there are first and second sets of aramid plies which sets are positioned on either side of the set of polyethylene plies to thereby sandwich the polyethylene plies between sets of aramid plies. Part of the reason for this is that the aramid plies are primarily responsible for the level of comfort of the insert 10. Another part of the reason is that the aramid plies may be stitched together and thus form ply sets 14A and 14B which have sufficient body to hold the individual polyethylene plies 16 in the set 16A close against one another in full surface contact with adjacent plies. Another part of the reason is that aramid is particularly fire resistent and it enhances the safety of the insert for the outboard plies to be of aramid.

The polyethylene fibers used in one embodiment are fibers made of polyethylene having a high molecular weight of approximately between 1,000,000 and 5,000,000 with a high degree of crystalline orientation (95% to 99%). These fibers are produced by a process of gel-spinning in which the polymer is dissolved in order to disentangle the polymer chains. The fibers derived from the subsequent spinning are an extended chain fiber having high molecular weight, very high degree of orientation and a minimum amount of chain folding. This type of fiber is made into the plies 16. This type of fiber is available commercially. This fiber is used as the basis for the plies 16 in a known process in which the fibers are laid down in a substantial orthogonal matrix (they are not woven) and are sealed or held in place by being fused with a polyethylene film.

What is claimed is:

1. A body armor set of ballistic material plies consisting essentially of:

a first subset of aramid plies, a second subset of aramid plies, a subset of polyethylene plies, said subset of polyethylene plies being sandwiched between said first and second subsets of aramid plies, each of said subsets of aramid plies consisting of multiple plies of ballistic material made from aramid fiber, said subset of polyethylene plies consisting of multiple plies of ballistic material made from polyethylene, a first one of said plies of said first subset and a first one of said plies of said second subset constituting the outer surface plies of said set of plies, each of the rest of said plies of each of said subsets having both first and second faces in full surface contact with a face of an adjacent ply, ballistic resistance being provided by a set of plies in face-to-face contact with each other in sequence from a first surface aramid ply through aramid plies, polyethylene plies and aramid plies to a second surface aramid ply.

2. The body armor of claim 1 wherein the total number of aramid plies in said first and second subsets together is greater than the number of polyethylene plies.

3. The body armor of claim 1 wherein the number of plies in said polyethylene subset of plies is greater than the number of plies in either said first or said second subset of aramid plies.

4. The body armor of claim 2 wherein the number of plies in said polyethylene subset of plies is greater than the number of plies in either said first or second subset of aramid plies.

5. The body armor of claim 1 wherein the aramid plies in each of said first and second subsets of plies are sewn to one another.

6. The body armor of claim 4 wherein the aramid plies in each of said first and second subsets of plies are sewn to one another.

7. The body armor of claim 5 having a shoulder region, all of said plies of all three of said subsets being sewn together in said shoulder region.

8. The body armor of claim 6 having a shoulder region, all of said plies of all three of said subsets being sewn together in said shoulder region.

9. A body armor set of ballistic material plies consisting essentially of:

a first subset of aramid plies, a second subset of aramid plies, a subset of polyethylene plies, said subset of polyethylene plies being sandwiched between said first and second subsets of aramid plies, each of said subsets of aramid plies consisting of at least four plies of ballistic material made from aramid fiber, said subset of polyethylene plies consisting of at least six plies of ballistic material made from polyethylene, a first one of said plies of said first subset and a first one of said plies of said second subset constituting the outer surface plies of said set of plies, each of the rest of said plies of each of said subsets having both first and second faces in full surface contact with a face of an adjacent ply, ballistic resistance being provided by a set of plies in face-to-face contact with each other in sequence from a first surface aramid ply through aramid plies, polyethylene plies and aramid plies to a second surface aramid ply.

10. The body armor of claim 9 wherein the aramid plies in each of said first and second subsets of plies are sewn to one another.

11. The body armor of claim 10 having a shoulder region, all of said plies of all three of said subsets being sewn together in said shoulder region.

* * * * *